US005425348A

United States Patent [19]

Bracken

[11] Patent Number: 5,425,348

[45] Date of Patent: Jun. 20, 1995

[54] DISTRIBUTORLESS IGNITION SYSTEM FOR AN INTERNAL COMBUSTION ENGINE

[75] Inventor: Norman H. Bracken, Anderson, Ind.

[73] Assignee: General Motors Corporation, Detroit, Mich.

[21] Appl. No.: 229,983

[22] Filed: Apr. 19, 1994

[51] Int. Cl.[6] ..... F02P 3/12

[52] U.S. Cl. ..... 123/643

[58] Field of Search ..... 123/643, 644, 655, 656, 123/621, 651, 637, 609, 603

[56] References Cited

U.S. PATENT DOCUMENTS

| | | | |
|---|---|---|---|
| 1,684,496 | 9/1928 | Lautenschlager | 123/627 |
| 3,861,369 | 1/1975 | Canup | 123/651 |
| 3,910,247 | 10/1975 | Hartig | 123/643 |
| 4,378,779 | 4/1983 | Hachiga et al. | 123/644 |
| 4,664,092 | 5/1987 | Kaufmann | 13/643 |
| 4,770,152 | 9/1988 | Mogi et al. | 123/621 |
| 4,862,862 | 9/1989 | Machida et al. | 123/609 |
| 4,893,605 | 1/1990 | Ozawa | 123/651 |
| 5,044,348 | 9/1991 | Ookawa | 123/637 |
| 5,127,388 | 7/1992 | Cicalese et al. | 123/644 |
| 5,228,425 | 1/1991 | Simons | 123/620 |
| 5,370,099 | 4/1994 | Koele et al. | 123/643 |

*Primary Examiner*—Raymond A. Nelli
*Attorney, Agent, or Firm*—Timothy G. Gorbatoff

[57] ABSTRACT

A distributorless ignition system for an internal combustion engine which discharges only one spark plug at a time. A high-level reversible voltage potential in selectively induced in the secondary winding of an ignition coil. Opposing diodes connected to the secondary winding permit application of the induced voltage across only one of two spark plug gaps, the central electrode of the spark plug being negatively charged with respect to ground to effectuate discharge with reduced power requirements and electrode erosion.

6 Claims, 4 Drawing Sheets

DISTRIBUTORLESS IGNITION SYSTEM FOR AN INTERNAL COMBUSTION ENGINE

The present invention relates to a distributorless ignition system for an internal combustion engine.

BACKGROUND OF THE INVENTION

FIG. 1 illustrates a prior an ignition system for a four-stroke four-cylinder engine requiring only one ignition coil. The ignition coil 14 comprises a primary 12 and secondary 16 winding. The primary winding 12 comprises series-connected first 12*a* and second 12*b* winding elements, the outer ends of which are connected to ground through two control transistors, 11 and 13, respectively. A battery 15 having a constant DC voltage potential is applied to an intermediate connecting point between the winding elements 12*a* and 12*b*.

Four spark plugs 26, 28, 30 and 32 having gaps formed therein are connected to the secondary winding 16 through diodes 18, 20, 22 and 24, respectively. Two spark plugs are connected to each end of the secondary winding, with their respective diodes arranged in reverse directions (oppositely poled) relative to one another.

Each spark plug gap is defined by two electrodes, an "earth" or "outer" electrode connected to ground and a "central" electrode connected to the secondary winding 16 through a diode.

The common end of both winding elements 12*a* and 12*b* is always at the DC voltage potential of the battery 15. With both transistors 11 and 13 off, the outer ends of the primary winding 12 are open-circuited so no current will flow through either winding element 12*a* and 12*b*.

When transistor 11 is turned on, the outer end of the first winding element 12*a* is effectively grounded, permitting current to flow through the first winding element 12*a* from the battery 15 to ground. The current flow produces a voltage potential in the first winding element 12*a* having a negative polarity at the grounded end with respect to the battery 15. As the current flow rises from zero to a steady-state value, a magnetic field is produced which induces a low-level voltage in the secondary winding 16 with the same polarity as that of the first winding element 12*a*.

When the transistor 11 is turned off, the magnetic field collapses, inducing a high-level voltage in the secondary winding 16 with a reverse polarity. The induced high-level voltage forward-biases two of the diodes, 20 and 22, causing arcing (i.e., discharge) between the electrodes of their respective spark plugs, 28 and 30. Conversely, similar operation of transistor 13 results in discharge of spark plugs 26 and 32. Therefore, selective operation of the two transistors, 11 and 13, provides a means of controlling the spark plug pairs to be discharged.

Note that in either mode of operation, the current discharge across the gaps of the two spark plugs is of opposite polarity, i.e., one of the two spark plugs being discharged has a negatively charged central electrode while the other has a positively charged central electrode.

Fuel is ignited near the end of the compression stroke of a cylinder by timed control of the appropriate transistor 11 and 13 to cause a current discharge across the electrodes of the spark plug 26–32 associated with the cylinder.

Since, as shown in FIG. 1, two spark plugs are discharged simultaneously, only one is for fuel ignition. The discharge of the other spark plug is during the exhaust stroke of its associated cylinder. Discharge of this spark plug serves no useful function and is therefore called the "waste-spark". It drains energy from the ignition system which would otherwise be used to discharge the compression-stroke spark plug.

The voltage drop across the waste-spark gap drains critical energy from discharge of the compression-stroke spark plug, requiring larger-sized ignition coils to compensate for the energy losses, adding to the overall cost of the ignition system.

FIG. 2 illustrates a prior an ignition system which eliminates discharge of the waste-spark. A single ignition coil 34 is provided for every two spark plugs, discharging only one of the spark plugs at any one time. The ignition system functions in much the same way as that described above for FIG. 1, except that one end of the secondary winding is grounded. As with FIG. 1, diodes 38 and 40 prevent the discharge of both spark plugs simultaneously. Only the compression-stroke spark plug is fired, thereby eliminating discharge of the waste-spark.

As with the ignition system of FIG. 1, the current discharge across the gaps of the spark plugs 42 and 44 are of opposite polarity in that discharge of one-half of the spark plugs within the engine is achieved by positively charging the spark plug central electrode and the other half by negatively charging the spark plug central electrode.

Optimally, the polarity of a spark plug central electrode during discharge should be negative. FIG. 3 illustrates a graph comparing erosion of positively and negatively charged central electrodes. As shown, erosion of spark plug electrodes is dramatically reduced (approx. 40% reduction) by discharging the spark plug with a negatively charged central electrode as compared to a positively charged one, increasing the useful life of the spark plug.

Additionally, a negatively charged central electrode breaks down the spark plug gap (i.e., achieves arcing) at a much lower voltage, thereby permitting reduced coil sizes and power requirements for a given application.

As can be seen, these desirable characteristics exist only with respect to one-half of the spark plugs in the systems of FIGS. 1 and 2.

SUMMARY OF THE PRESENT INVENTION

The present invention is directed to a distributorless ignition system for an internal combustion engine in which the secondary winding of an ignition coil controls the current discharge across a pair of spark plug gaps wherein only one spark plug is discharged at a time and wherein each of the spark plugs are discharged by applying a high-level negative voltage potential to its central electrode with respect to ground.

According to one aspect of the invention, interposed between each end of the secondary winding and ground is a diode connected in parallel with a spark plug gap. The two diodes are arranged in reverse directions relative to one another such that their anodes are coupled together and to the grounded earth electrode of the spark plugs. The cathode of each diode is coupled to a respective end of the secondary winding and a central electrode of one of the spark plugs. This arrangement of the two diodes ensures that the spark plug gaps are not fired simultaneously by the ignition coil.

By selectively applying a current in reverse directions through the ignition coil's primary winding, a high-level voltage potential is induced in the secondary winding having a polarity dependent upon the direction of the primary winding current flow. The induced voltage effectively forward-biases one or the other of the two diodes, creating a short-circuit around its respective spark plug gap, permitting discharge of only the opposing spark plug gap. Discharge of a spark plug is achieved by applying the high-level voltage potential across the spark plug gap such that it's central electrode is negatively charged with respect to the grounded earth electrode.

According to another aspect of the invention, the primary winding is comprised of two winding elements which are series-connected. A battery having a constant DC voltage potential applied to an intermediate connecting point. The outer ends of the winding elements are connected to a control means which operates to selectively apply a current in either one of the two winding elements to produce a reversible voltage potential in the primary winding for inducing a reversible voltage potential in the secondary winding.

DETAILED DESCRIPTION OF THE PREFERRED EMBODIMENTS

Figure 4A:
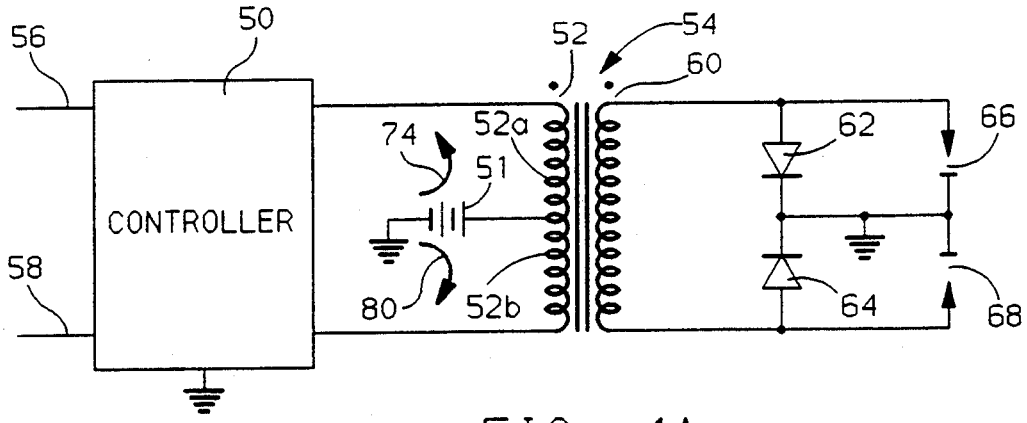
FIGS. 4A–B illustrate an ignition system in accordance with this invention.

Referring to FIG. 4A, the ignition system according to the present invention comprises a control means 50, battery 51 and an ignition coil 54 having a primary 52 and secondary winding 60. Interposed between each end of the secondary winding 60 and ground is a diode 62 and 64 connected in parallel with a spark plug 66 and 68, respectively, having a gap formed therein. Each spark plug gap is defined by two electrodes, an "earth" or "outer" electrode connected to ground and a "central" electrode connected to a respective end of the secondary winding 60.

The two diodes 62 and 64 are arranged in reverse directions relative to one another such that their anodes are coupled together and to the grounded earth electrodes of spark plugs 66 and 68. The cathode of each diode is coupled to a respective end of the secondary winding 60 and a central electrode of one of the spark plugs 66 and 68.

Each diode 62 and 64 represent either a single diode or a stack of diodes similarly arranged with respect to one another. Diode stacks are well-known to those skilled in the art for the purpose of increasing breakdown voltage.

The ignition coil's primary winding 52 is comprised of a first **52*a* and second winding element 52*b* connected in series with each other. The battery 51 is connected at the positive pole thereof to the primary winding 52 at an intermediate connection point between the winding elements 52*a* and 52*b*. The outer ends of the winding elements 52*a* and 52*b* are connected to the control means 50**.

The control means 50 controls the flow of current through the primary winding 52 in response to timed firing signals received from a controller (not shown) over signal lines 56 and 58. The ignition system of FIG. 4A operates in one of two modes. In a first mode, the control means 50 initiates current flow 74 through the first winding element **52*a* from the battery 51 to ground in one direction, the outer end of the first winding element 52*a* connected to the control means 50 having a negative voltage potential with respect to the end connected to the battery 51**.

In a second mode, the control means 50 initiates current flow 80 through the second winding element **52*b* from the battery 51 to ground, the outer end of the second winding element 52*b* connected to the control means 50 having a negative voltage potential with respect to the end connected to the battery 51. The direction of current flow through the primary winding 52 and its resultant voltage polarity in this mode is reverse that of the former mode. Therefore, the control means 50 is capable of selectively applying a current in reverse directions through the primary winding 52 to produce a reversible voltage polarity in the primary winding 52**.

Figure 4B:
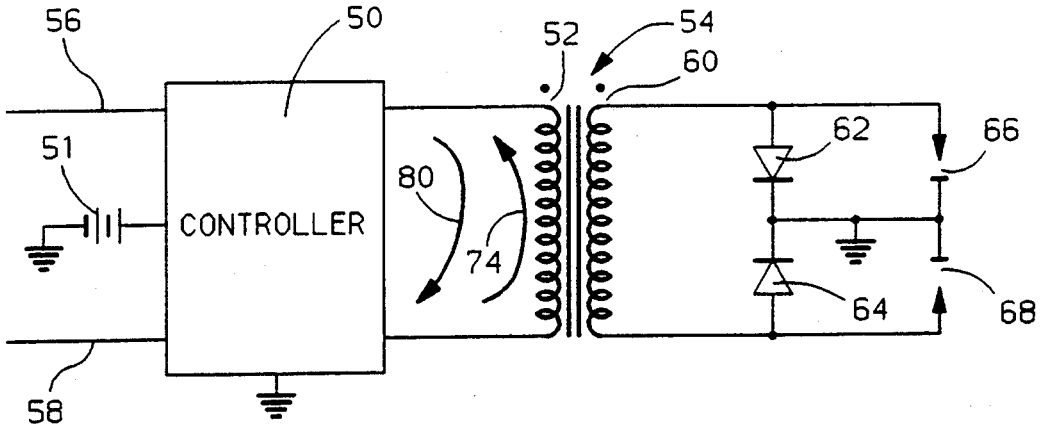

Alternatively, as illustrated in FIG. 4B, the primary winding 52 can be comprised of a single winding connected to the control means 50, the battery 51 being connected to the control means 50. Operation of the control means 50 in response to firing signals received over signal lines 56 and 58 initiates current flow from the battery 51 to ground through the entire primary winding 52 in either direction, 74 or 80, depending upon which firing signal is received, 56 or 58, respectively.

In either embodiment, as current flow in either direction begins to rise through the primary winding 52, a magnetic field is generated which couples the ignition coil's primary 52 and secondary windings 60. This magnetic field induces a low-level voltage in the secondary winding 60 with the same polarity as that in the primary winding 52. The polarity of this voltage reverse-biases one of the two diodes 62 and 64 permitting application of the low-level voltage across one of the two spark plug gaps 66 and 68, respectively.

The firing signals are timed to ensure that the low-level voltages are applied only to spark plug gaps located within cylinders in other than their compression-stroke. This ensures that accidental discharge (spark-on-make) as a result of a low-level voltage does not occur in a cylinder containing compressed fuel, and does not drain energy from the firing of the appropriate spark plug gap.

When the current through the primary winding 52 is interrupted by the control means 50, the magnetic field collapses, inducing a transient high-level voltage in the secondary winding 60 of reverse polarity. This high-level voltage potential forward-biases one of the two diodes 62 and 64, thereby short-circuiting its respective spark plug 66 and 68, respectively. The high level voltage potential is applied across the opposing spark plug gap such that its central electrode will be negatively charged with respect to its grounded earth electrode. The voltage potential is sufficient to cause arcing across the gap, resulting in ignition (discharge) of the combustible fuels contained within the cylinder.

As described in reference to the prior art systems, the voltage drop across the waste-spark gap drains critical energy from discharge of the compression-stroke spark plug, requiring larger-sized ignition coils to compensate for the energy losses, adding to the overall cost of the ignition system.

Figure 1:
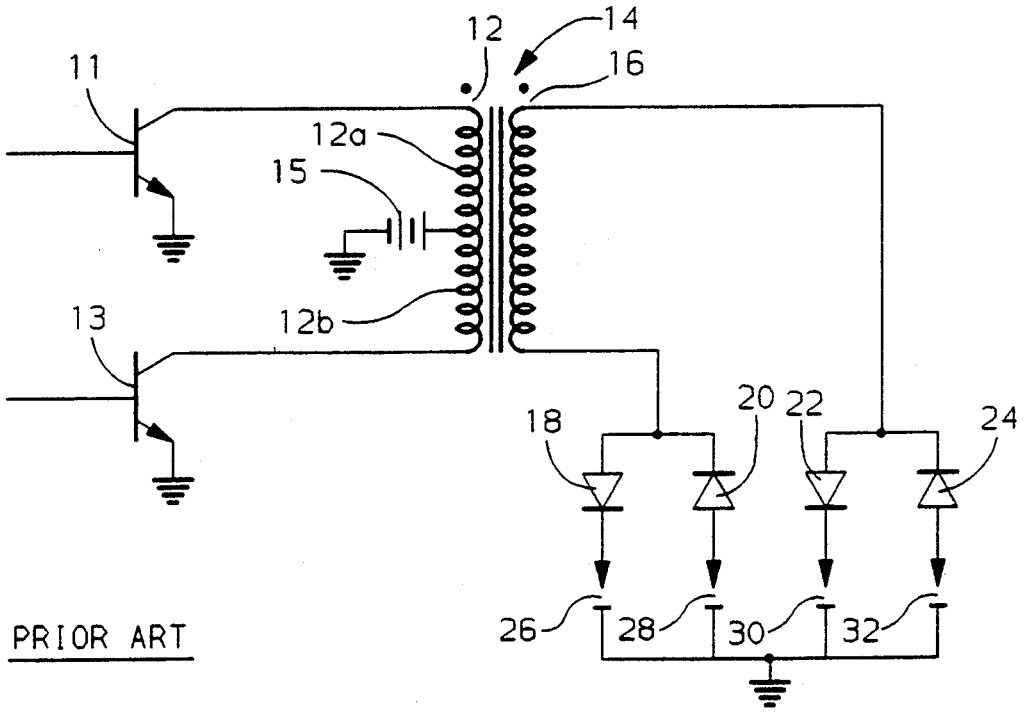
FIG. 1 illustrates a prior art ignition system which discharges two spark plugs simultaneously, one of the spark plugs being discharged with a positively charged central electrode.
Figure 2:
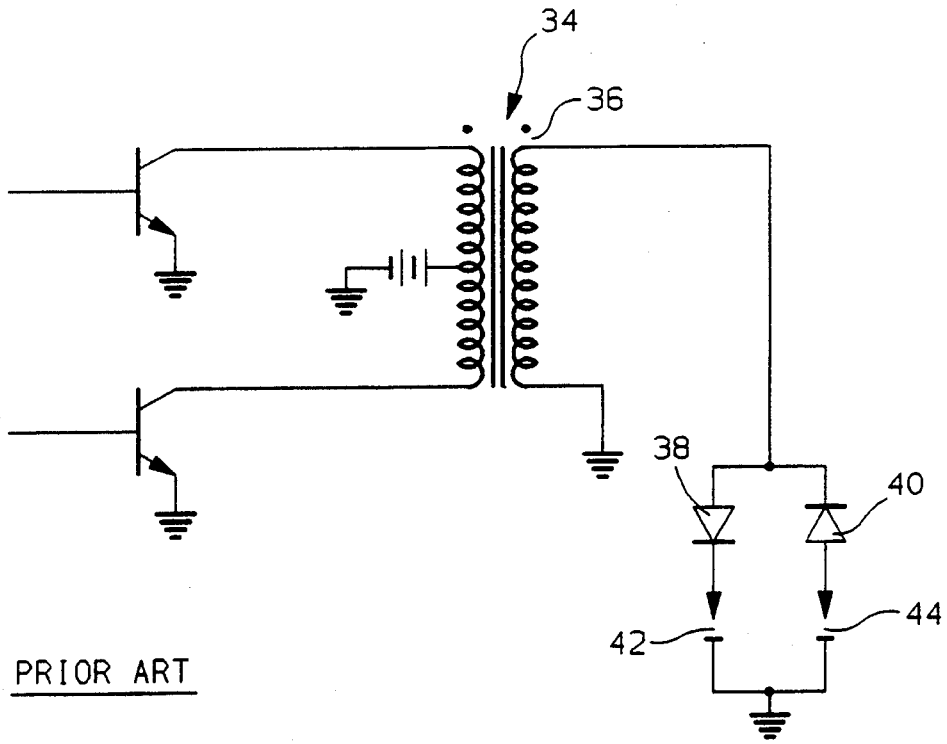
FIG. 2 illustrates a prior art ignition system which discharges only one spark plug at a time, one of every two spark plugs being discharged with a positively charged central electrode.
Figure 3:
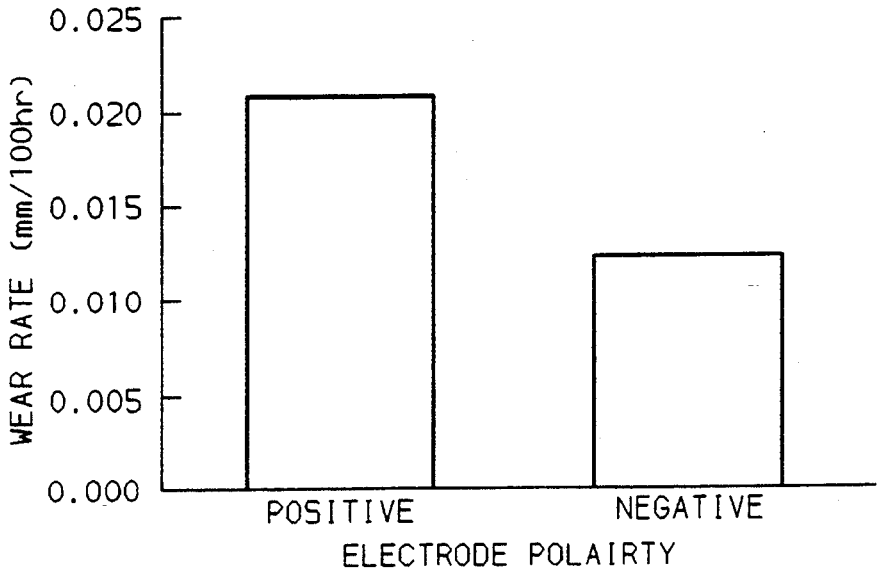
FIG. 3 illustrates a graph comparing erosion of positively and negatively charged central electrodes.

The polarity of a spark plug central electrode during discharge should be negative. A negative electrode breaks down the spark plug gap (i.e., achieves arcing) at a lower voltage (approx. 10% reduction), thereby permitting reduced coil sizes and power requirements for a given application. In addition, referring back to FIG. 3, discharge of a spark plug with a negatively charged electrode results in less electrode erosion over time as compared to a positively charged electrode.

The high-level voltage potential induced in the secondary winding 60 of FIGS. 4A–B is applied across one of the two spark plug gaps 66 and 68. Which one of the two spark plugs is discharged depends upon in which of the two modes the system is operating. FIGS. 5A–B and FIGS. 6A–B illustrate the operation of each of the two modes.

As demonstrated in the following description of operation, this invention both eliminates waste spark and discharges each spark plug with a negatively charged central electrode.

Figure 5A:
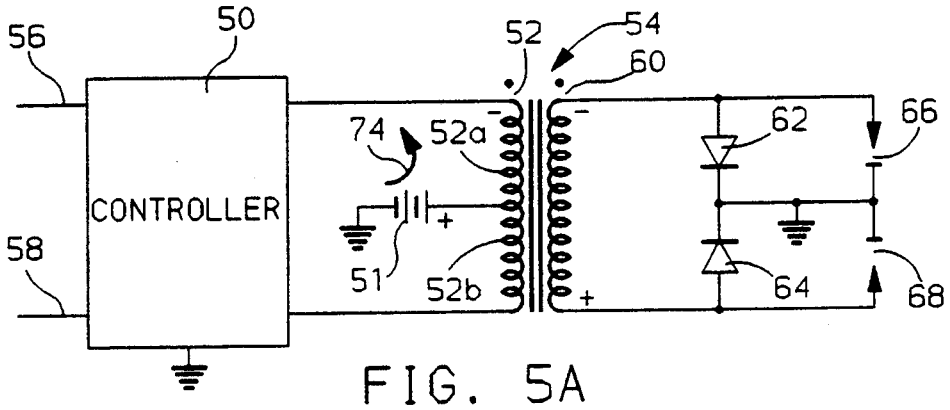
FIGS. 5A–B illustrate the firing of a first spark plug in response to a first direction of current flow.
Figure 5B:
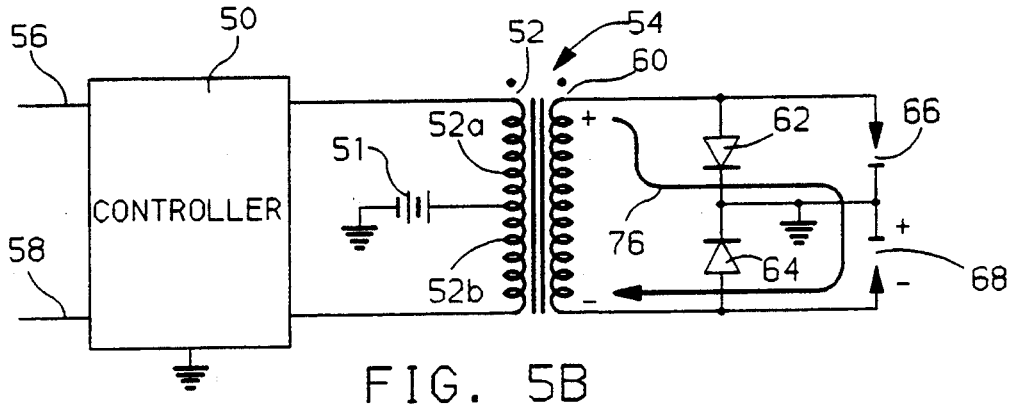

FIGS. 5A–B illustrate a first mode of operation. Referring to FIG. 5A, the control circuit 50 produces a current flow 74 through the first winding element **52*a* from the battery 51 to ground in response to a timed firing signal received over signal line 56. The exponentially rising current 74 in the first winding element 52*a* produces a magnetic field in the ignition coil 54 which induces a low-level voltage in the secondary winding 60 of the same polarity. Referring to FIG. 5B, discharge of a spark plug is initiated by control circuit 50 interrupting the current flow 74 through the first winding element 52*a*, causing the existing magnetic field to collapse. As the magnetic field collapses, it induces a high-level voltage potential in the secondary winding 60 with a reverse polarity. The induced voltage forward-biases diode 62 and reverse-biases diode 64, allowing a current 76 to flow. Notice that the forward-biased diode 62 creates a short-circuit around spark plug gap 66, permitting application of the high-level voltage only across spark plug 68**.

The high-level voltage potential induced in the secondary winding 60 is applied across spark plug 68 such that the spark plug central electrode has a negative polarity with respect to the grounded earth electrode. Arcing occurs, igniting the air-fuel mixture in the cylinder.

The firing signal 56 is timed such that spark plug 68 discharges in a cylinder which is near the end of a compression stroke, resulting in power generation beginning with the next stroke. Spark plug 66 represents a spark plug in a cylinder other than at the end of its compression-stroke, referred to as the waste-spark. By using diode 62 as a short-circuit, the ignition system is able to eliminate the waste-spark.

Figure 6A:
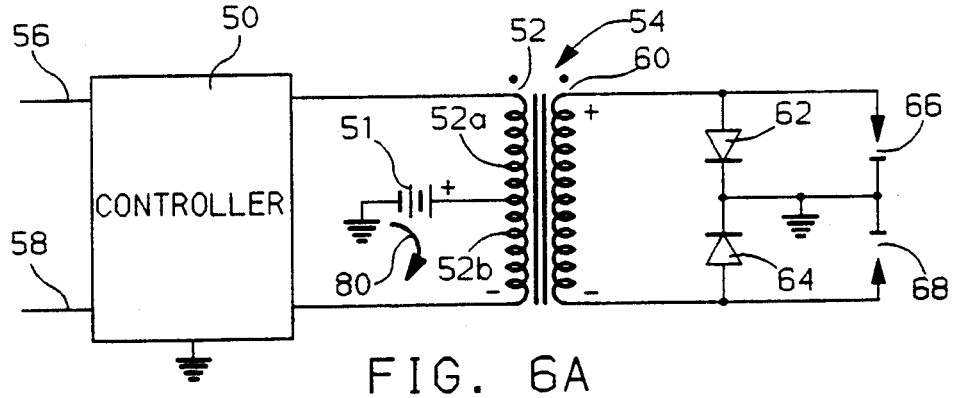
FIGS. 6A–B illustrate the firing of a second spark plug in response to a second direction of current flow.
Figure 6B:
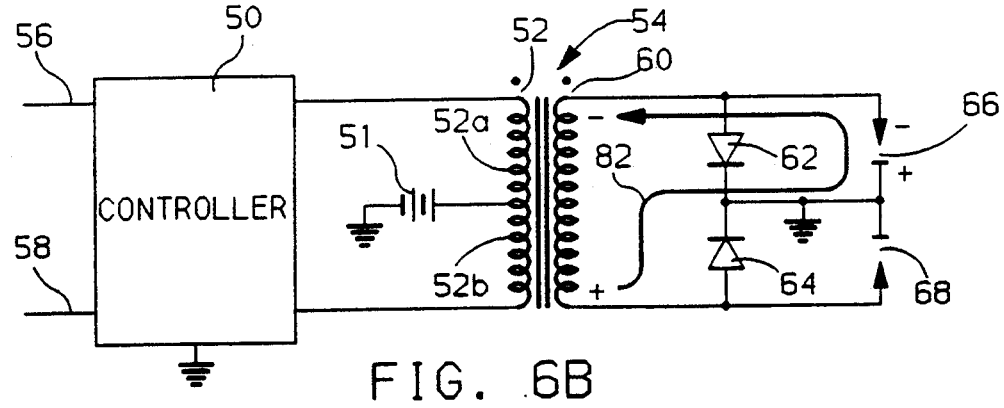

FIGS. 6A–B illustrate a second mode of operation. Referring to FIG. 6A, the control circuit 50 produces a current flow 80 through the second winding element **52*b* from the battery 51 to ground in response to a timed firing signal received over signal line 58. The exponentially rising current 80 in the second winding element 52*b* produces a magnetic field in the ignition coil 54 which induces a low-level voltage in the secondary winding 60** of the same polarity.

Referring to FIG. 6B, discharge of a spark plug is initiated by the control circuit 50 interrupting the current flow 80 through the second winding element **52*b*, causing the existing magnetic field to collapse. As the magnetic field collapses, it induces a high-level voltage potential in the secondary winding 60 with reverse polarity. The induced voltage forward-biases diode 64 and reverse-biases diode 62, allowing a current 82 to flow. Notice that the forward-biased diode 64 creates a short-circuit around spark plug 68, permitting application of the high-level voltage only across spark plug 66**.

The high-level voltage potential induced in the secondary winding 60 is applied across spark plug 66 such that the spark plug central electrode has a negative polarity with respect to the grounded earth electrode. Arcing occurs, igniting the air-fuel mixture in the cylinder.

The firing signal 58 is timed such that spark plug 66 discharges in a cylinder which is near the end of a compression stroke, resulting in power generation beginning with the next stroke. Spark plug 68 represents a spark plug in a cylinder other than at the end of its compression-stroke, and represents the waste-spark in this mode of operation. By using diode 64 as a short-circuit, the ignition system is able to eliminate the waste-spark.

Figure 7:
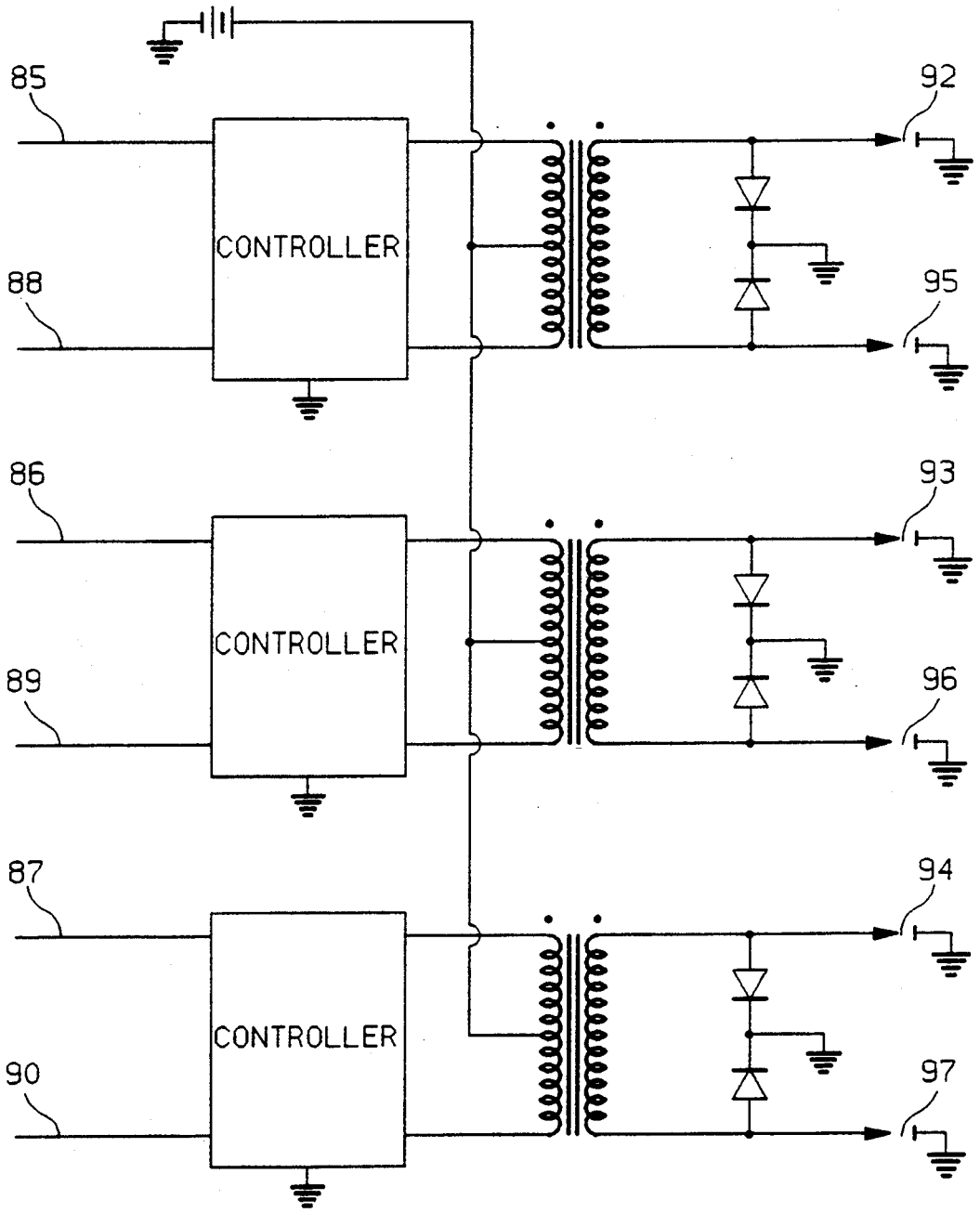
FIG. 7 illustrates an ignition system in accordance with this invention for use with a six-cylinder engine.

The present invention can be incorporated into an internal combustion engine with more than two cylinders by adding ignition coils, one for every two cylinders. FIG. 7 illustrates the use of the present invention in a six-cylinder engine. The firing signals 85–90 would be timed to identify the respective spark plugs 92–97 to discharge.

The embodiments of this invention in which an exclusive property or privilege is claimed are defined as follows:

1. An ignition system for an internal combustion engine, comprising:

an ignition coil having a primary winding and secondary winding;

control means for selectively applying a current in reverse directions through the primary winding to induce a reversible voltage in the secondary winding;

a first spark plug having a first electrode connected to a first end of the secondary winding and a second electrode spaced from the first electrode to establish a first spark gap;

a second spark plug having a first electrode connected to a second end of the secondary winding and a second electrode connected to the second electrode of the first spark plug and spaced from the first electrode of the second spark plug to establish a second spark plug gap;

a first diode connected in parallel with the first spark plug gap; and a second diode connected in parallel with the second spark plug gap and arranged in a reverse direction relative to the first diode, whereby (i) one of the first and second spark plug gaps is discharged by a voltage applied to its first electrode in response to a first voltage polarity induced in the secondary winding, and (ii) the other of the first and second spark plug gaps is discharged by a voltage applied to its first electrode in response to a second voltage polarity induced in the secondary winding.

2. The ignition system according to claim 1, wherein the first electrode of each of the spark plugs is a central electrode and the second electrode of each of the spark plugs is a grounded earth electrode.

3. The ignition system according to claim 2, wherein each of the first and second diodes has an anode and a cathode and wherein the anode of the first diode is connected to the central electrode of the first spark plug and the anode of the second diode is connected to the central electrode of the second spark plug.

4. The ignition system according to claim 1, wherein the first voltage polarity induced in the secondary winding (i) forward-biases the first diode, providing a short-circuit around the first spark plug gap thereby preventing voltage from being applied across the first spark plug gap, and (ii) reverse-biases the second diode, providing an open-circuit around the second spark plug gap thereby enabling the first voltage to be applied across the second spark plug gap with a polarity such that a negative voltage is applied to its first electrode, discharging the second spark plug gap.

5. The ignition system according to claim 1, wherein the second voltage polarity induced in the secondary winding (i) forward-biases the second diode, providing a short-circuit around the second spark plug gap thereby preventing voltage from being applied across the second spark plug gap, and (ii) reverse-biases the first diode, providing an open-circuit around the first spark plug gap thereby enabling the second voltage to be applied across the first spark plug gap with a polarity such that a negative voltage is applied to its first electrode, discharging the first spark plug gap.

6. The ignition system according to claim 1, wherein the primary winding comprises a first winding element connected in series with a second winding element, a battery connected to an intermediate connecting point between the first and second winding elements, the outer ends of the first and second winding elements connected to the control means, whereby the current is selectively applied to one of the first and second winding elements by the control means to induce the reversible voltage in the secondary winding.

* * * * *